US010859299B2

(12) United States Patent
Tanaka et al.

(10) Patent No.: US 10,859,299 B2
(45) Date of Patent: Dec. 8, 2020

(54) AIR-CONDITIONING APPARATUS AND REFRIGERANT LEAKAGE DETECTION METHOD

(71) Applicant: Mitsubishi Electric Corporation, Tokyo (JP)

(72) Inventors: Kenyu Tanaka, Tokyo (JP); Masahiko Takagi, Tokyo (JP); Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 47 days.

(21) Appl. No.: 16/326,725

(22) PCT Filed: Nov. 16, 2016

(86) PCT No.: PCT/JP2016/083883
§ 371 (c)(1),
(2) Date: Feb. 20, 2019

(87) PCT Pub. No.: WO2018/092197
PCT Pub. Date: May 24, 2018

(65) Prior Publication Data
US 2019/0264965 A1 Aug. 29, 2019

(51) Int. Cl.
*F25B 49/02* (2006.01)
*F25B 49/00* (2006.01)
*F25B 13/00* (2006.01)

(52) U.S. Cl.
CPC ..... *F25B 49/02* (2013.01); *F25B 13/00* (2013.01); *F25B 49/005* (2013.01);
(Continued)

(58) Field of Classification Search
CPC ..... F25B 49/02; F25B 13/00; F25B 49/005; F25B 2313/0315; F25B 2313/0314; F25B 2500/222
See application file for complete search history.

(56) References Cited

U.S. PATENT DOCUMENTS 6,701,722 B1 * 3/2004 Seo ..... F25B 13/00 62/129
2014/0238060 A1 * 8/2014 Tamaki ..... F25B 49/02 62/127

(Continued)

FOREIGN PATENT DOCUMENTS

JP 2000-081258 A 3/2000
JP 2015-230136 A 12/2015

(Continued)

OTHER PUBLICATIONS

International Search Report of the International Searching Authority dated Feb. 7, 2017 for the corresponding international application No. PCT/JP2016/083883 (and English translation).

*Primary Examiner* — Kun Kai Ma
(74) *Attorney, Agent, or Firm* — Posz Law Group, PLC

(57) ABSTRACT

An air-conditioning apparatus includes a refrigerant circuit, an indoor fan, a temperature sensor provided in an area adjacent to a seam in a refrigerant pipe of the refrigerant circuit, and a controller configured to determine the presence of refrigerant leakage on the basis of a decrease in the temperature measured by the temperature sensor. The controller is configured to determine the presence of refrigerant leakage while the indoor fan is stopped, and stop the determination of the presence of refrigerant leakage while a defrosting operation is performed.

6 Claims, 10 Drawing Sheets

(52) U.S. Cl.
CPC ..... *F25B 2313/0314* (2013.01); *F25B 2313/0315* (2013.01); *F25B 2500/222* (2013.01)

(56) References Cited

U.S. PATENT DOCUMENTS

| | | | | |
|---|---|---|---|---|
| 2016/0091241 | A1* | 3/2016 | Suzuki | F25D 17/067 62/186 |
| 2017/0370605 | A1* | 12/2017 | Makino | F24F 11/77 |
| 2018/0292118 | A1* | 10/2018 | Suzuki | F25B 49/005 |
| 2018/0299169 | A1* | 10/2018 | Suzuki | F24F 11/36 |
| 2019/0024931 | A1* | 1/2019 | Suzuki | F24F 11/65 |
| 2019/0032941 | A1* | 1/2019 | Kawai | F24F 11/77 |
| 2019/0063808 | A1* | 2/2019 | Suzuki | F24F 11/36 |
| 2019/0203997 | A1* | 7/2019 | Sakae | F25B 5/02 |
| 2019/0383511 | A1* | 12/2019 | Tomita | F24F 11/38 |

FOREIGN PATENT DOCUMENTS

| | | | |
|---|---|---|---|
| JP | 2016-011767 | A | 1/2016 |
| JP | 2016-125694 | A | 7/2016 |
| WO | 2015/029094 | A1 | 3/2015 |

* cited by examiner

AIR-CONDITIONING APPARATUS AND REFRIGERANT LEAKAGE DETECTION METHOD

CROSS REFERENCE TO RELATED APPLICATION

This application is a U.S. national stage application of International Application No. PCT/JP2016/083883, filed on Nov. 16, 2016, the contents of which are incorporated herein by reference.

TECHNICAL FIELD

The present invention relates to an air-conditioning apparatus and a refrigerant leakage detection method, for determining whether or not refrigerant leakage is present with use of temperature sensors each provided in an area adjacent to a seam in a refrigerant pipe.

BACKGROUND

Some refrigerants used in an air-conditioning apparatus have flammability. If refrigerant leaks and the concentration of the leaking refrigerant exceeds a predetermined lower flammable limit, the refrigerant is caused to be ignited.

Consequently, there is known a technology of detecting refrigerant leakage by providing a temperature sensor and utilizing the principle that refrigerant drops in temperature when leaked and released to the atmosphere (see, for example, Patent Literature 1).

Areas prone to refrigerant leakage from the indoor unit of an air-conditioning apparatus are flared connections in which pipes are machined or connected on the installation site. Consequently, there is known a technology in which a temperature sensor is arranged in the vicinity of such a flared connection to detect refrigerant leakage (see, for example, Patent Literature 2).

If the temperature sensor configured to detect a decrease in temperature at a time of refrigerant leakage is arranged in an area, inside the indoor unit, where refrigerant is liable to leak, the problem may be caused in that, when an ambient temperature largely changes, this change may be falsely detected by a controller as refrigerant leakage on the basis of the temperature measured by the temperature sensor. Consequently, there is known a technology in which, while the compressor is stopped, the controller constantly calculates the difference between the temperature of the indoor heat exchanger, that is, the temperature of the leaking refrigerant, and the temperature of indoor air, and determines that refrigerant has leaked when this temperature difference has decreased at a predetermined rate or more (see, for example, Patent Literature 3).

Patent Literature

Patent Literature 1: Japanese Unexamined Patent Application Publication No. 2016-11767

Patent Literature 2: Japanese Unexamined Patent Application Publication No. 2015-230136

Patent Literature 3: Japanese Unexamined Patent Application Publication No. 2000-81258

In the related art, the controller is allowed to determine the presence of refrigerant leakage when the indoor fan is in a stopped condition, in which the concentration of the leaked refrigerant increases.

The temperature sensor is arranged in a location susceptible to the influence of the temperature of refrigerant flowing in the refrigerant pipe. During, for example, defrosting operation, the indoor fan is not running when the controller determines whether or not refrigerant leakage is present, and thus the refrigerant flowing through the refrigerant pipe in the indoor unit is at a decreased temperature. Consequently, the controller may provide false detection of refrigerant leakage on the basis of a decrease in the temperature measured by the temperature sensor.

SUMMARY

The present invention has been made to solve the above-mentioned problem, and thus it is an object of the present invention to provide an air-conditioning apparatus and a refrigerant leakage detection method, which are capable of preventing false detection of refrigerant leakage when the temperature of a refrigerant pipe is low.

According to one embodiment of the present invention, there is provided an air-conditioning apparatus including a refrigerant circuit in which a compressor, an indoor heat exchanger, an expansion device, an outdoor heat exchanger, and a switching device configured to switch operation to a heating operation or a defrosting operation are connected by a refrigerant pipe to circulate refrigerant, an indoor fan configured to supply air to the indoor heat exchanger, a temperature sensor located in a vicinity of at least one of an outlet and an inlet of the indoor heat exchanger in the refrigerant circuit, the temperature sensor being provided in an area adjacent to a seam in the refrigerant pipe, and a controller configured to determine the presence of refrigerant leakage on the basis of a decrease in the temperature measured by the temperature sensor, in which the controller is configured to determine the presence of refrigerant leakage during a period in which the indoor fan is stopped, and to stop the determination of the presence of refrigerant leakage during a period in which the defrosting operation is performed.

According to one embodiment of the present invention, there is provided refrigerant leakage detection method including measuring, in a refrigerant circuit in which refrigerant is circulated to perform a heating operation, in which air is supplied to an indoor heat exchanger with use of an indoor fan, or a defrosting operation, a temperature of an area in the vicinity of a seam in a refrigerant pipe, determining, during a period in which the indoor fan is stopped, the presence of refrigerant leakage on the basis of a decrease in the measured temperature, and stopping, during a period in which the defrosting operation is performed, the determination of the presence of refrigerant leakage on the basis of the decrease in the measured temperature.

With the air-conditioning apparatus and the refrigerant leakage detection method according to one embodiment of the present invention, the controller determines the presence of refrigerant leakage during the period in which the indoor fan is stopped, and stops the determination of the presence of refrigerant leakage during the period in which the defrosting operation is performed. This configuration prevents false detection of refrigerant leakage from being made when the temperature of the refrigerant pipe is low.

DETAILED DESCRIPTION

Figure 1:
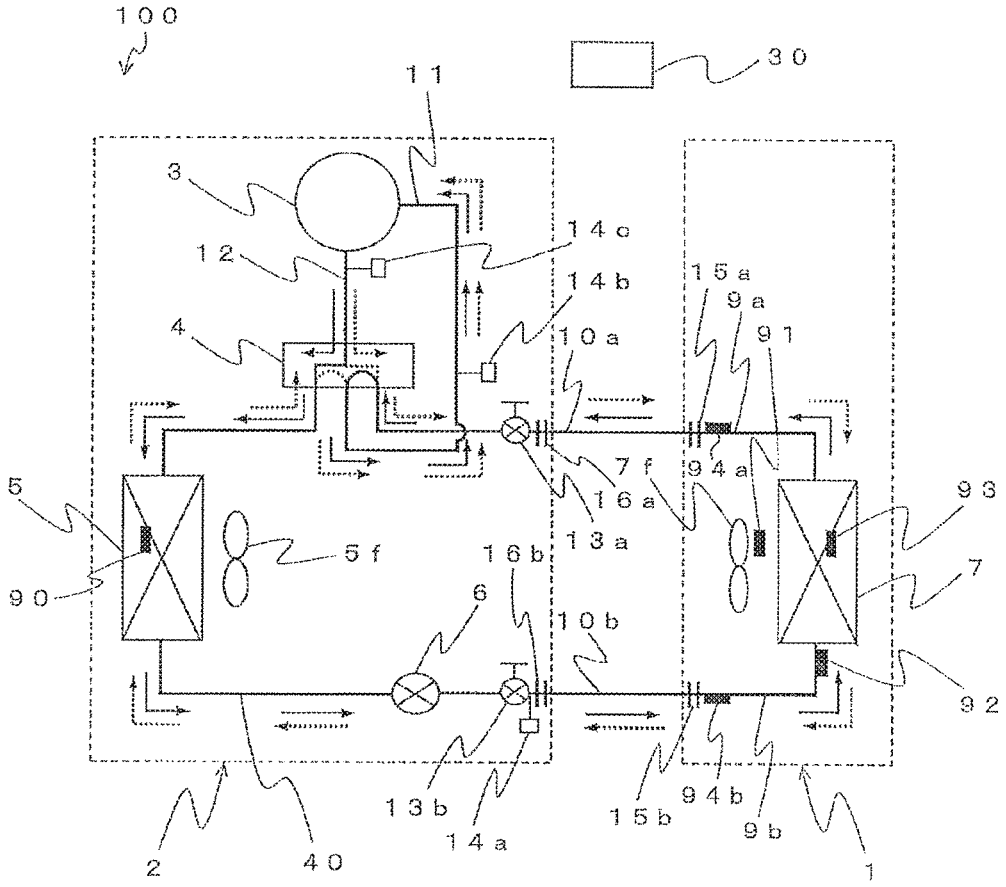
FIG. 1 is a refrigerant circuit diagram for illustrating the schematic configuration of an air-conditioning apparatus according to Embodiment 1 of the present invention.

Embodiments of the present invention are described below with reference to the drawings.

In the drawings, the same reference signs are used to designate like or equivalent elements, and the same reference signs apply throughout this specification.

Further, the modes of components described throughout this specification are merely examples, and the modes of components are not limited to those described.

Embodiment 1

FIG. 1 is a refrigerant circuit diagram for illustrating the schematic configuration of an air-conditioning apparatus 100 according to Embodiment 1 of the present invention. In the drawings including FIG. 1 referred to below, features such as dimensional relationships and shapes of components may be different from the real ones in some cases.

As illustrated in FIG. 1, the air-conditioning apparatus 100 includes a refrigerant circuit 40 in which refrigerant circulates. The refrigerant circuit 40 includes the following components sequentially connected in a loop by a refrigerant pipe, a compressor 3, an indoor heat exchanger 7, a pressure reducing device 6, an outdoor heat exchanger 5, and a refrigerant flow switching device 4 configured to switch the operation to a cooling operation, a heating operation, or a defrosting operation.

The pressure reducing device 6 corresponds to an expansion device of the present invention. The refrigerant flow switching device 4 corresponds to a switching device of the present invention.

The air-conditioning apparatus 100 includes, as a heat source unit, an outdoor unit 2 that is arranged outdoors, for example. The air-conditioning apparatus 100 includes, as a load unit, an indoor unit 1 that is arranged indoors, for example. The indoor unit 1 and the outdoor unit 2 are connected to each other by extension pipes 10*a* and 10*b* each serving as a part of the refrigerant pipe.

Examples of refrigerant that circulates in the refrigerant circuit 40 include a mildly flammable refrigerant, for example, HFO-1234yf or HFO-1234ze, and a highly flammable refrigerant, for example, R290 or R1270.

Each of these refrigerants may be used as a single-component refrigerant, or may be used as a refrigerant mixture of two or more types of refrigerant. Refrigerants with levels of flammability equal to or higher than mild flammability (for example, 2L or higher in the ASHRAE-34 classification) are hereinafter sometimes referred to as "flammable refrigerants". A non-flammable refrigerant that has non-flammability (for example, "1" in the ASHRAE-34 classification), for example, R22 or R410A, may also be used as the refrigerant that circulates in the refrigerant circuit 40.

These refrigerants have densities greater than that of air under atmospheric pressures, for example.

The compressor 3 is a fluid machine configured to compress a low-pressure refrigerant sucked into the compressor 3, and discharges the compressed refrigerant as a high-pressure refrigerant.

The refrigerant flow switching device 4 switches the direction of refrigerant flow in the refrigerant circuit 40 between the cooling operation and the heating operation. The refrigerant flow switching device 4 switches the direction of refrigerant flow in the refrigerant circuit 40 such that, in the defrosting operation, refrigerant flows in the same direction as that in the cooling operation. As the refrigerant flow switching device 4, for example, a four-way valve is used.

The outdoor heat exchanger 5 acts as a radiator serving as, for example, a condenser, in the cooling operation, and acts as an evaporator in the heating operation. In the outdoor heat exchanger 5, heat is exchanged between the refrigerant flowing in the outdoor heat exchanger 5, and the outdoor air being supplied by an outdoor fan 5*f* described later.

The pressure reducing device 6 reduces the pressure of a high-pressure refrigerant to turn the refrigerant into a low-pressure refrigerant. As the pressure reducing device 6, for example, an electronic expansion valve with an adjustable opening degree is used.

The indoor heat exchanger 7 acts as an evaporator in the cooling operation, and acts as a radiator serving as, for example, a condenser, in the heating operation. In the indoor heat exchanger 7, heat is exchanged between the refrigerant flowing in the indoor heat exchanger 7, and the air being supplied by an indoor fan 7*f* described later.

The cooling operation refers to an operation in which a low-temperature and low-pressure refrigerant is supplied to the indoor heat exchanger 7. The heating operation refers to an operation in which a high-temperature and high-pressure refrigerant is supplied to the indoor heat exchanger 7. The defrosting operation refers to an operation performed at some point during the heating operation to melt and remove frost formed on the outdoor heat exchanger 5 of the outdoor unit 2.

The outdoor unit 2 accommodates the compressor 3, the refrigerant flow switching device 4, the outdoor heat exchanger 5, and the pressure reducing device 6.

The outdoor unit 2 accommodates the outdoor fan 5*f* configured to supply outdoor air to the outdoor heat exchanger 5. The outdoor fan 5*f* is arranged to be opposed to the outdoor heat exchanger 5. When the outdoor fan 5*f* rotates, a flow of air passing through the outdoor heat exchanger 5 is generated. As the outdoor fan 5*f*, for example, a propeller fan is used. The outdoor fan 5*f* is arranged, for example, downstream of the outdoor heat exchanger 5 with respect to the flow of air generated by the outdoor fan 5*f*.

Refrigerant pipes arranged in the outdoor unit 2 include a refrigerant pipe connecting an extension-pipe connection valve 13*a* and the refrigerant flow switching device 4 and serving as a gas-side refrigerant pipe in the cooling operation, a suction pipe 11 connected to the suction side of the compressor 3, a discharge pipe 12 connected to the discharge side of the compressor 3, a refrigerant pipe connecting the refrigerant flow switching device 4 and the outdoor heat exchanger 5, a refrigerant pipe connecting the outdoor heat exchanger 5 and the pressure reducing device 6, and a refrigerant pipe connecting an extension-pipe connection valve 13*b* and the pressure reducing device 6 and serving as a liquid-side refrigerant pipe in the cooling operation.

The extension-pipe connection valve 13*a* is formed by a two-way valve capable of being switched to be opened or closed. A joint portion 16*a*, for example, a flare joint, is mounted at one end of the extension-pipe connection valve 13*a*.

The extension-pipe connection valve 13*b* is formed by a three-way valve capable of being switched to be opened or closed. A service port 14*a*, which is used during vacuuming performed prior to filling the refrigerant circuit 40 with refrigerant, is mounted at one end of the extension-pipe connection valve 13*b*. A joint portion 16*b*, for example, a flare joint, is mounted at the other end of the extension-pipe connection valve 13*b*.

A high-temperature and high-pressure gas refrigerant compressed by the compressor 3 flows through the discharge pipe 12 in each of the cooling operation, the heating operation, and the defrosting operation.

A low-temperature and low-pressure gas refrigerant or two-phase refrigerant that has undergone evaporation flows through the suction pipe 11 in each of the cooling operation, the heating operation, and the defrosting operation.

A service port 14*b* with flare joint, which is a low pressure-side service port, is connected to the suction pipe 11.

A service port 14*c* with flare joint, which is a high pressure-side service port, is connected to the discharge pipe 12.

The service ports 14*b* and 14*c* are used to connect a pressure gauge to measure operating pressure during a test run made at the time of installation or repair of the air-conditioning apparatus 100.

The outdoor unit 2 is provided with an outdoor pipe temperature sensor 90 configured to measure outdoor refrigerant temperature in the outdoor heat exchanger 5 of the outdoor unit 2.

The outdoor pipe temperature sensor 90 outputs a detection signal to a controller 30 configured to control the overall operation of the air-conditioning apparatus.

The indoor unit 1 accommodates the indoor heat exchanger 7.

The indoor unit 1 accommodates the indoor fan 7*f* configured to supply air to the indoor heat exchanger 7. When the indoor fan 7*f* rotates, a flow of air passing through the indoor heat exchanger 7 is generated.

Depending on the type of the indoor unit 1, a centrifugal fan, for example, a sirocco fan or a turbo fan, a cross-flow fan, a mixed flow fan, or an axial fan, for example, a propeller fan, is used as the indoor fan 7*f*.

The indoor fan 7*f* is arranged upstream of the indoor heat exchanger 7 with respect to the flow of air generated by the indoor fan 7*f*. However, the position of the indoor fan 7*f* is not limited to this configuration. The indoor fan 7*f* may be arranged downstream of the indoor heat exchanger 7.

Among the refrigerant pipes of the indoor unit 1, an indoor pipe 9*a* on the gas side is provided with a joint portion 15*a*, for example, a flare joint, which is located at the connecting portion to the extension pipe 10*a* on the gas side to connect to the extension pipe 10*a*.

Further, among the refrigerant pipes of the indoor unit 1, an indoor pipe 9*b* on the liquid side is provided with a joint portion 15*b*, for example, a flare joint, which is located at the connecting portion to the extension pipe 10*b* on the liquid side to connect to the extension pipe 10*b*.

The indoor unit 1 is provided with a suction air temperature sensor 91 configured to measure the temperature of indoor air sucked in from the indoor space.

The indoor unit 1 is provided with a heat exchanger liquid pipe temperature sensor 92 configured to measure the temperature of liquid refrigerant at the location of the indoor heat exchanger 7 that becomes the inlet during the cooling operation or the outlet during the heating operation.

The indoor unit 1 is provided with a heat exchanger two-phase pipe temperature sensor 93 configured to detect evaporating temperature or condensing temperature, which is the temperature of two-phase refrigerant in the indoor heat exchanger 7.

Further, the indoor unit 1 is provided with temperature sensors 94*a* and 94*b* used for refrigerant leakage detection described later.

The temperature sensors 91, 92, 93, 94*a*, and 94*b* each output a detection signal to the controller 30 configured to control the overall operation of the air-conditioning apparatus.

The controller 30 has a microcomputer including components such as a CPU, a ROM, a RAM, an input-output port, and a timer. The controller 30 is capable of performing data communication with an operating unit 26 (see FIG. 2). The operating unit 26 receives an operation made by the user, and outputs an operation signal based on the operation to the controller 30.

The controller 30 controls, on the basis of an operation signal from the operating unit 26 or detection signals from various sensors, the overall operation of the air-conditioning apparatus including operations of the compressor 3, the refrigerant flow switching device 4, the pressure reducing device 6, the outdoor fan 5*f*, and the indoor fan 7*f*.

The controller 30 may be provided inside the housing of the indoor unit 1, or may be provided inside the housing of the outdoor unit 2. The controller 30 may include an outdoor-unit control unit provided in the outdoor unit 2, and an indoor-unit control unit provided in the indoor unit 1 and capable of performing data communication with the outdoor-unit control unit.

Next, operation of the refrigerant circuit 40 of the air-conditioning apparatus 100 is described.

First, the cooling operation is described. In FIG. 1, the solid arrows indicate the flow of refrigerant in the cooling operation. The refrigerant circuit 40 is configured such that, in the cooling operation, the flows of refrigerant are switched by the refrigerant flow switching device 4 as indicated by the solid arrows to direct a low-temperature and low-pressure refrigerant into the indoor heat exchanger 7.

A high-temperature and high-pressure gas refrigerant discharged from the compressor 3 first enters the outdoor heat exchanger 5 via the refrigerant flow switching device 4. In the cooling operation, the outdoor heat exchanger 5 acts as a condenser. That is, in the outdoor heat exchanger 5, heat is exchanged between the refrigerant flowing in the outdoor heat exchanger 5 and the outdoor air being supplied by the outdoor fan 5*f*, and the condensation heat of the refrigerant is rejected to the outdoor air. This operation causes the refrigerant entering the outdoor heat exchanger 5 to condense into a high-pressure liquid refrigerant. The high-pressure liquid refrigerant enters the pressure reducing device 6 in which its pressure is reduced, and the refrigerant turns into a low-pressure and two-phase refrigerant. The low-pressure and two-phase refrigerant enters the indoor heat exchanger 7 of the indoor unit 1 via the extension pipe 10*b*. In the cooling operation, the indoor heat exchanger 7 acts as an evaporator. That is, in the indoor heat exchanger 7, heat is exchanged between the refrigerant flowing in the indoor heat exchanger 7 and, for example, the indoor air being supplied by the indoor fan 7*f*, and the evaporation heat of the refrigerant is removed from the air. This operation causes the refrigerant entering the indoor heat exchanger 7 to evaporate into a low-pressure gas refrigerant or two-phase refrigerant. The air supplied by the indoor fan 7*f* is cooled when the refrigerant removes heat from the air. The low-pressure gas refrigerant or two-phase refrigerant evaporating in the indoor heat exchanger 7 is sucked into the compressor 3 via the extension pipe 10*a* and the refrigerant flow switching device 4. The refrigerant sucked into the compressor 3 is compressed into a high-temperature and high-pressure gas refrigerant. The above-mentioned cycle is repeated in the cooling operation.

Next, the heating operation is described. In FIG. 1, the dotted arrows indicate the flow of refrigerant in the heating operation. The refrigerant circuit 40 is configured such that, in the heating operation, the flows of refrigerant are switched by the refrigerant flow switching device 4 as indicated by the dotted arrows to direct a high-temperature and high-pressure refrigerant to flow into the indoor heat exchanger 7. In the heating operation, the refrigerant flows in a direction opposite to that in the cooling operation, and the indoor heat exchanger 7 acts as a condenser. That is, in the indoor heat exchanger 7, heat is exchanged between the refrigerant flowing in the indoor heat exchanger 7 and the air being supplied by the indoor fan 7*f*, and the condensation heat of the refrigerant is rejected to the air. The air supplied by the indoor fan 7*f* is thus heated when the refrigerant rejects heat to the air.

Next, the defrosting operation is described. When the heating operation is performed in low outdoor temperature conditions, frost is formed on the outdoor heat exchanger 5. Frost formation on the outdoor heat exchanger 5 leads to reduced heating capacity of the air-conditioning apparatus 100, which may prevent a target indoor temperature from being reached. Consequently, the defrosting operation is performed at some point during the heating operation to remove frost from the outdoor heat exchanger 5.

In the defrosting operation, refrigerant flows in the direction indicated by the solid arrows in FIG. 1 as in the cooling operation. A high-temperature and high-pressure gas refrigerant discharged from the compressor 3 first enters the outdoor heat exchanger 5 via the refrigerant flow switching device 4. In the defrosting operation, the outdoor heat exchanger 5 acts as a condenser. That is, in the outdoor heat exchanger 5, heat is exchanged between the refrigerant flowing in the outdoor heat exchanger 5 and the outdoor air being supplied by the outdoor fan 5*f*, and the condensation heat of the refrigerant is rejected to the outdoor air. As a result, the frost formed on the surface of the outdoor heat exchanger 5 is caused to melt. The refrigerant entering the outdoor heat exchanger 5 condenses into a high-pressure liquid refrigerant. The high-pressure liquid refrigerant enters the pressure reducing device 6 in which its pressure is reduced, and the refrigerant turns into a low-pressure and two-phase refrigerant. The low-pressure and two-phase refrigerant enters the indoor heat exchanger 7 of the indoor unit 1 via the extension pipe 10*b*. In the defrosting operation, the air-sending operation of the indoor fan 7*f* is stopped. In other words, in the indoor heat exchanger 7, heat is less likely to be exchanged between the refrigerant flowing in the indoor heat exchanger 7 and the air being supplied by the indoor fan 7*f*. With this operation, low-temperature air is prevented from being blown out from the indoor unit 1 during the defrosting operation, which is performed in the middle of the heating operation. The refrigerant entering the indoor heat exchanger 7 evaporates into a low-pressure gas refrigerant or two-phase refrigerant. The low-pressure gas refrigerant or two-phase refrigerant evaporating in the indoor heat exchanger 7 is sucked into the compressor 3 via the extension pipe 10*a* and the refrigerant flow switching device 4. The refrigerant sucked into the compressor 3 is compressed into a high-temperature and high-pressure gas refrigerant. The above-mentioned cycle is repeated in the defrosting operation.

Figure 2:
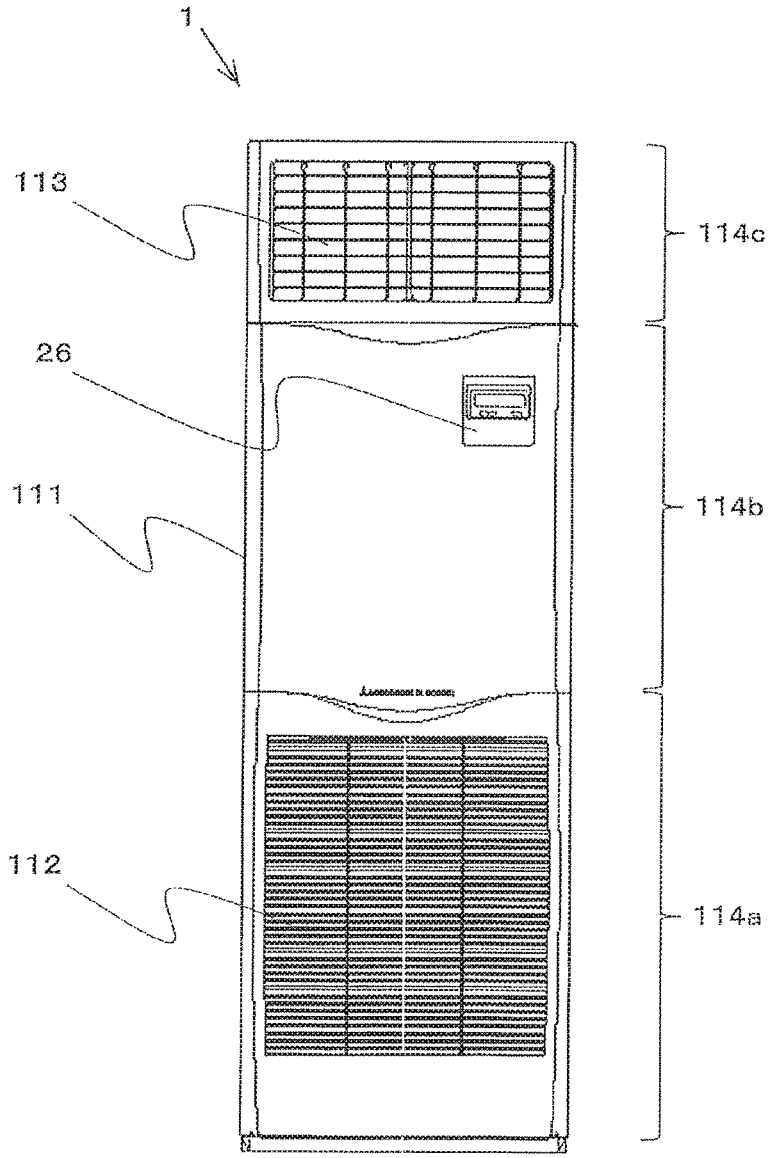
FIG. 2 is a front view for illustrating the outer appearance of an indoor unit of the air-conditioning apparatus according to Embodiment 1 of the present invention.
Figure 3:
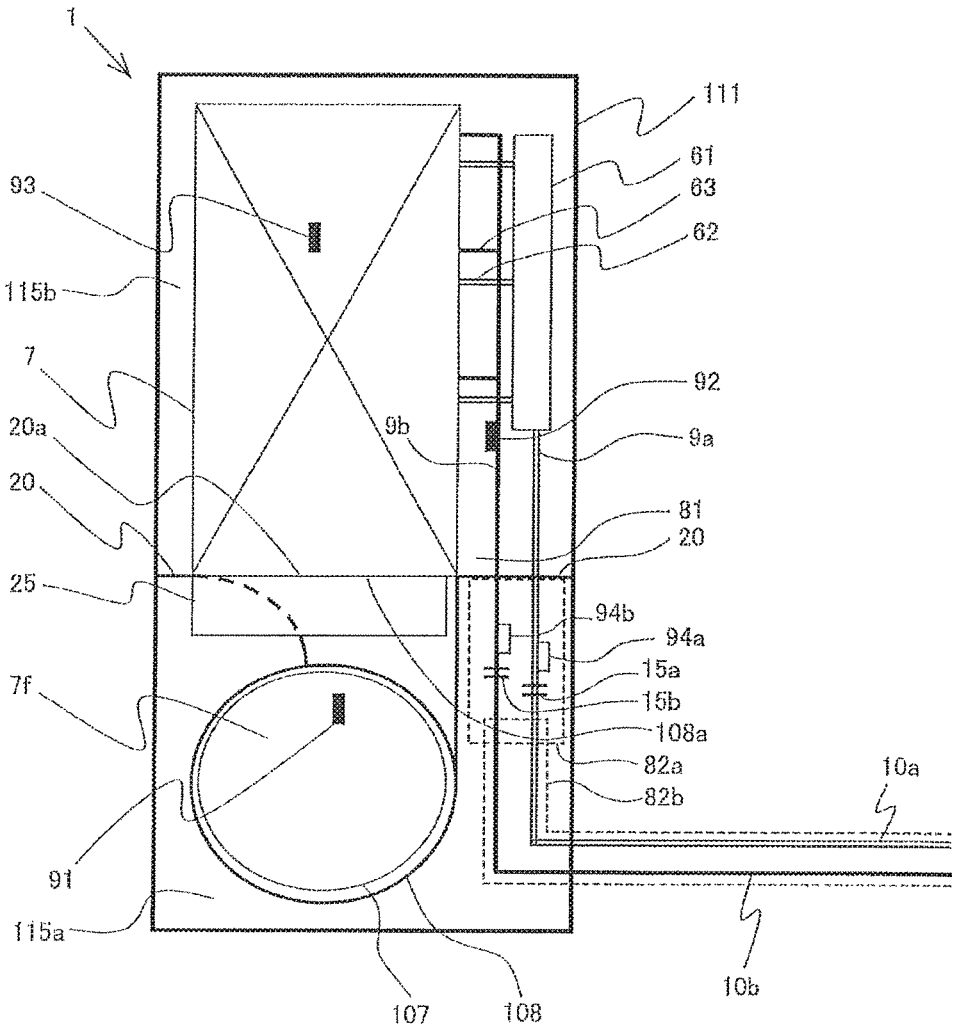
FIG. 3 is a front view for schematically illustrating the internal structure of the indoor unit of the air-conditioning apparatus according to Embodiment 1 of the present invention.
Figure 4:
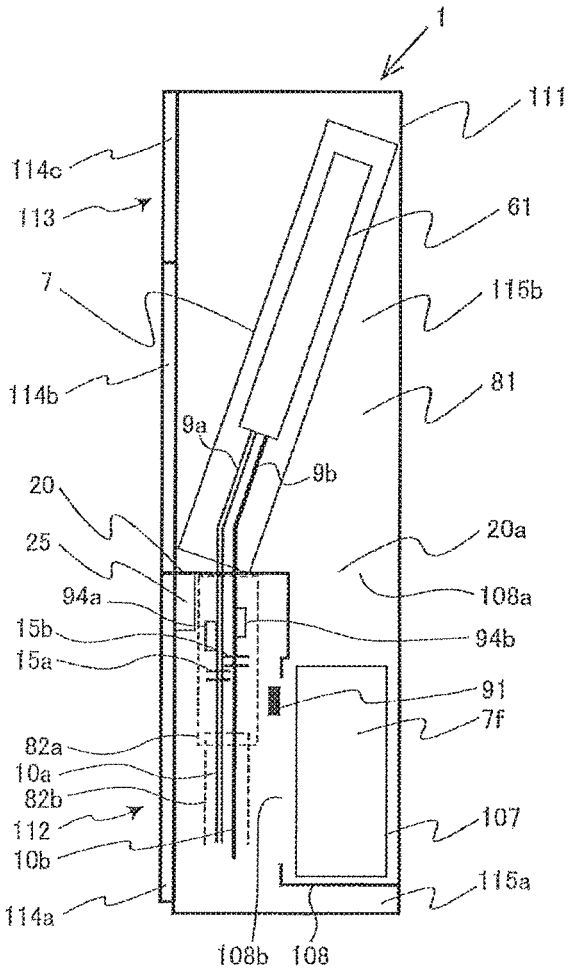
FIG. 4 is a side view for schematically illustrating the internal structure of the indoor unit of the air-conditioning apparatus according to Embodiment 1 of the present invention.

FIG. 2 is a front view for illustrating the outer appearance of the indoor unit 1 of the air-conditioning apparatus 100 according to Embodiment 1 of the present invention. FIG. 3 is a front view for schematically illustrating the internal structure of the indoor unit 1 of the air-conditioning apparatus 100 according to Embodiment 1 of the present invention. FIG. 4 is a side view for schematically illustrating the internal structure of the indoor unit 1 of the air-conditioning apparatus 100 according to Embodiment 1 of the present invention. The left-hand side in FIG. 4 indicates the side toward the indoor space corresponding to the front side of the indoor unit 1.

Embodiment 1 employs, as an example of the indoor unit 1, the indoor unit 1 of a floor type arranged on the floor surface of the indoor space that is an air-conditioned space. As a general rule, the positional relationships of components, for example, their vertical arrangement, in the following description are those obtained when the indoor unit 1 is arranged in its ready-to-use position.

As illustrated in FIG. 2 to FIG. 4, the indoor unit 1 includes a housing 111 having a vertically elongated rectangular parallelepiped shape.

An air inlet 112 for sucking indoor air is located in a lower part of the front surface of the housing 111. The air inlet 112 is located at a position below the central part of the housing 111 in a vertical direction of the housing 111 and close to the floor surface.

An air outlet 113 for blowing out the air sucked in through the air inlet 112 is located in an upper part of the front surface of the housing 111, that is, at a position higher than the air inlet 112, for example, at a position above the central part of the housing 111 in the vertical direction.

The operating unit 26 is disposed on the front surface of the housing 111 at a position above the air inlet 112 and below the air outlet 113. The operating unit 26 is connected to the controller 30 via a communication line, and is capable of performing data communication with the controller 30. The operating unit 26 is operated by the user to perform operations such as starting and ending the operation of the air-conditioning apparatus 100, switching of operation modes, and setting of a preset temperature and a preset air flow rate. The operating unit 26 is provided with a display, an audio output unit, or other components as an informing unit configured to provide information to the user.

The housing 111 is a hollow box. The front surface of the housing 111 is provided with a front opening. The housing 111 includes a first front panel 114*a*, a second front panel 114*b*, and a third front panel 114*c* that are removably attached to the front opening. Each of the first front panel 114*a*, the second front panel 114*b*, and the third front panel 114*c* has a substantially rectangular, flat outer shape.

The first front panel 114*a* is removably attached to a lower part of the front opening of the housing 111. The first front panel 114*a* is provided with the air inlet 112.

The second front panel 114*b* is disposed above and adjacent to the first front panel 114*a*, and is removably attached to the central part of the front opening of the housing 111 in the vertical direction. The second front panel 114*b* is provided with the operating unit 26.

The third front panel 114*c* is disposed above and adjacent to the second front panel 114*b*, and is removably attached to an upper part of the front opening of the housing 111. The third front panel 114*c* is provided with the air outlet 113.

The internal space of the housing 111 is roughly divided into a lower space 115*a* serving as an air-sending part, and an upper space 115*b* located above the lower space 115*a* and serving as a heat-exchanging part.

The lower space 115*a* and the upper space 115*b* are partitioned off by a partition unit 20. The partition unit 20 has the shape of, for example, a flat plate, whose surface is oriented substantially horizontally. The partition unit 20 is provided with at least an air passage opening 20*a* serving as an air passage between the lower space 115*a* and the upper space 115*b*.

The lower space 115*a* is exposed to the front side when the first front panel 114*a* is detached from the housing 111.

The upper space 115*b* is exposed to the front side when the second front panel 114*b* and the third front panel 114*c* are detached from the housing 111.

The partition unit 20 is arranged at substantially the same height as that of the upper end of the first front panel 114*a* or the lower end of the second front panel 114*b*. The partition unit 20 may be formed integrally with a fan casing 108 described later, may be formed integrally with a drain pan described later, or may be formed as a component separate from the fan casing 108 and the drain pan.

The indoor fan 7*f* is provided in the lower space 115*a* to generate, in an air passage 81 in the housing 111, a flow of air that travels toward the air outlet 113 from the air inlet 112. The indoor fan 7*f* is a sirocco fan including a motor (not shown), and an impeller 107 connected to the output shaft of the motor and having a plurality of blades arranged circumferentially at equal intervals, for example. The impeller 107 is arranged such that its rotation axis is substantially parallel to the direction of the depth of the housing 111. The motor used for the indoor fan 7*f* is a non-brush type motor, for example, an induction motor or a DC brushless motor. This configuration ensures that the rotation of the indoor fan 7*f* causes no sparking.

The impeller 107 of the indoor fan 7*f* is covered by the fan casing 108 having a spiral shape. The fan casing 108 is formed as a component separate from, for example, the housing 111. An air inlet opening 108*b* for sucking the indoor air into the fan casing 108 through the air inlet 112 is located in the vicinity of the center of the spiral of the fan casing 108. The air inlet opening 108*b* is located opposite to the air inlet 112. Further, an air outlet opening 108*a* for blowing out the air to be sent is located in the tangential direction of the spiral of the fan casing 108. The air outlet opening 108*a* is directed upward, and is connected to the upper space 115*b* via the air passage opening 20*a* of the partition unit 20. In other words, the air outlet opening 108*a* communicates to the upper space 115*b* via the air passage opening 20*a*. The open end of the air outlet opening 108*a* and the open end of the air passage opening 20*a* may be directly connected to each other, or may be indirectly connected to each other via a component, for example, a duct member.

A microcomputer constructing, for example, the controller 30, and an electrical component box 25 for accommodating components such as various electrical components and a board are provided in the lower space 115*a*.

The upper space 115*b* is located downstream of the lower space 115*a* with respect to the flow of air generated by the indoor fan 7*f*. The indoor heat exchanger 7 is provided in the air passage 81 in the upper space 115*b*.

A drain pan (not shown) is arranged below the indoor heat exchanger 7 to receive condensed water that has condensed on the surface of the indoor heat exchanger 7. The drain pan may be formed as a part of the partition unit 20, or may be formed as a component separate from the partition unit 20 and disposed on the partition unit 20.

During driving the indoor fan 7*f*, indoor air is sucked in through the air inlet 112. The sucked indoor air passes through the indoor heat exchanger 7 and turns into conditioned air, which is blown out into the indoor space from the air outlet 113.

The indoor heat exchanger 7 is a plate fin-tube heat exchanger including a plurality of fins arranged in parallel at predetermined intervals, and a plurality of heat transfer tubes penetrating the plurality of fins and in which refrigerant is circulated. The heat transfer tubes each include a plurality of hairpin tubes with a long straight tube portion penetrating the plurality of fins, and a plurality of U-bent tubes that allow adjacent hairpin tubes to communicate to each other. The hairpin tube and the U-bent tube are joined by a brazed portion.

The number of heat transfer tubes to be provided may be one, or more than one. The number of hairpin tubes constructing each single heat transfer tube may be also one or more than one.

The heat exchanger two-phase pipe temperature sensor 93 is provided to a U-bent tube located in the middle portion of the refrigerant path of the heat transfer tube.

The indoor pipe 9*a* on the gas side is connected to a header main pipe having a cylindrical shape. The header main pipe is connected to a plurality of header branch pipes that branch off from the main header pipe. Each of the header branch pipes is connected to one end portion of the corresponding heat transfer tube. The indoor pipe 9*b* on the liquid side is connected to a plurality of indoor refrigerant branch pipes that branch off from the indoor pipe 9*b*. Each of the indoor refrigerant branch pipes is connected to the other end portion of the corresponding heat transfer tube.

The heat exchanger liquid pipe temperature sensor 92 is provided to the indoor pipe 9*b*.

The indoor pipe 9*a* and the header main pipe, the header main pipe and the header branch pipe, the header branch pipe and the heat transfer tube, the indoor pipe 9*b* and the indoor refrigerant branch pipe, and the indoor refrigerant branch pipe and the heat transfer tube are each joined by a brazed portion.

Figure 5:
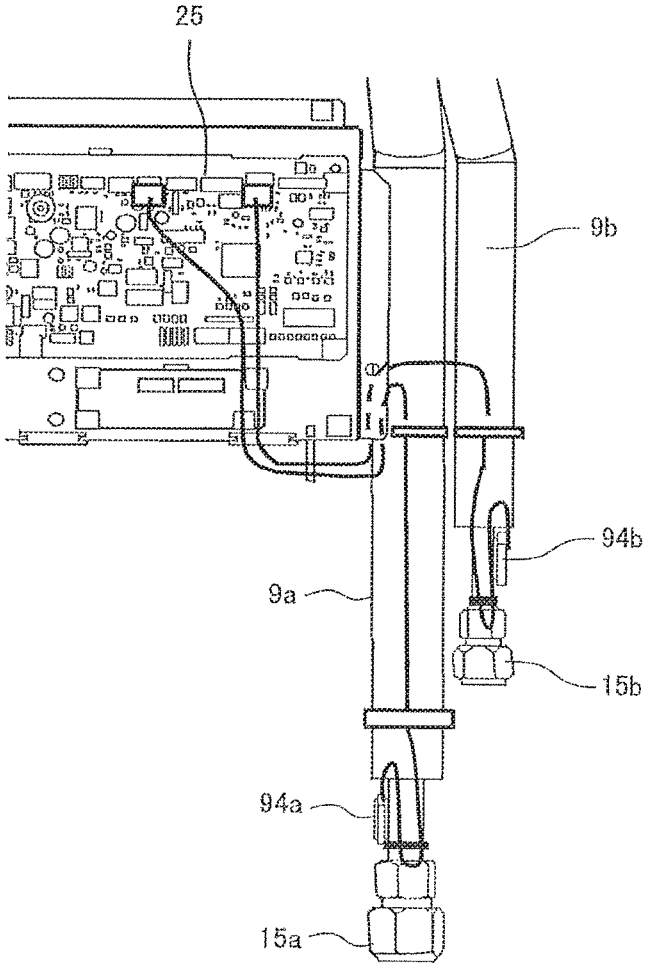
FIG. 5 is a front view for schematically illustrating the configuration of temperature sensors each provided to the corresponding refrigerant pipe of the air-conditioning apparatus according to Embodiment 1 of the present invention and the configuration of components in the vicinity of the temperature sensors.

FIG. 5 is a front view for schematically illustrating the configuration of the temperature sensors 94*a* and 94*b* each provided to the corresponding one of the indoor pipes 9*a* and 9*b* serving as refrigerant pipes of the air-conditioning apparatus 100 according to Embodiment 1 of the present invention, and the configuration of components in the vicinity of the temperature sensors 94*a* and 94*b*.

As illustrated in FIG. 3 to FIG. 5, the indoor pipes 9*a* and 9*b* leading to the indoor heat exchanger 7 are extended downward through the partition unit 20 from the upper space 115*b* to the lower space 115*a*. The joint portion 15*a* that connects the indoor pipe 9*a* to the extension pipe 10*a* and the joint portion 15*b* that connects the indoor pipe 9*b* to the extension pipe 10*b* are provided in the lower space 115*a*.

As illustrated in FIG. 5, the temperature sensors 94*a* and 94*b* used for refrigerant leakage detection are provided in the lower space 115*a* separately from the suction air temperature sensor 91. The temperature sensor 94*a* is provided to the indoor pipe 9*a*, which is a refrigerant pipe through which refrigerant flows in the heating operation at a temperature higher than that in the defrosting operation. In the refrigerant circuit 40, the temperature sensor 94*a* is provided to the indoor pipe 9*a* located in the vicinity of the inlet of the indoor heat exchanger 7, and is provided in an area adjacent to the joint portion 15*a* on the indoor pipe 9*a* while in contact with the outer peripheral surface of the indoor pipe 9*a*. The temperature sensor 94*a* is disposed, for example, above and in the vicinity of the joint portion 15*a*.

The temperature sensor 94*b* is provided to the indoor pipe 9*b*, which is a refrigerant pipe through which refrigerant flows in the heating operation at a temperature higher than that in the defrosting operation. In the refrigerant circuit 40, the temperature sensor 94*b* is provided to the indoor pipe 9*b* located in the vicinity of the outlet of the indoor heat exchanger 7, and is provided in an area adjacent to the joint portion 15*b* on the indoor pipe 9*b* while in contact with the outer peripheral surface of the indoor pipe 9*b*. The temperature sensor 94*b* is disposed, for example, above and in the vicinity of the joint portion 15*b*.

The temperature sensor 94*a* and 94*b* are respectively provided in areas adjacent to the seams in which the joint portions 15*a* and 15*b* that connect the indoor pipes 9*a* and 9*b* to the extension pipes 10*a* and 10*b*, respectively, are located. However, instead of an area adjacent to the joint portion 15*a* and 15*b*, each of the temperature sensors 94*a* and 94*b* may be provided in areas each adjacent to the seam in which a joint between two refrigerant pipes, that is, the extension pipe 10*a* and the indoor pipe 9*a*, or the extension pipe 10*b* and the indoor pipe 9*b*, which are joined together by brazing, welding, or other processing, is located.

The temperature sensors 94*a* and 94*b* are each mounted to a predetermined location by the manufacturer of the air-conditioning apparatus in the manufacturing stage of the indoor unit 1. The wires connecting the temperature sensor 94*a* and 94*b* to the electrical component box 25 are mounted to the indoor pipes 9*a* and 9*b* with clamping bands, respectively, while allowing slack in the wires by the manufacturer of the air-conditioning apparatus in the manufacturing stage of the indoor unit 1. As a result, each of the temperature sensors 94*a* and 94*b* can be positioned in advance in the indoor unit 1 that is in its pre-installation state. This configuration eliminates the need for positioning the temperature sensors 94*a* and 94*b* at the time of installation of the indoor unit 1 when the indoor pipes 9*a* and 9*b* and the extension pipes 10*a* and 10*b* are connected, respectively, which in turn improves working efficiency and eliminates variations in the positioning of the temperature sensors 94*a* and 94*b* or errors in installation.

The portions of the extension pipes 10*a* and 10*b* below the joint portions 15*a* and 15*b* are covered by a heat insulating material 82*b* to prevent condensation from being formed. Two extension pipes 10*a* and 10*b* are collectively covered by the single heat insulating material 82*b*, but each of the extension pipes 10*a* and 10*b* may be covered by a different heat insulating material. In general, the extension pipes 10*a* and 10*b* are prepared by an installation operator who installs the air-conditioning apparatus 100. The heat insulating material 82*b* may be already attached at the time of purchase of the extension pipes 10*a* and 10*b*. Alternatively, the installation operator may prepare the extension pipes 10*a* and 10*b* and the heat insulating material 82*b* separately, and may attach the heat insulating material 82*b* to the extension pipes 10*a* and 10*b* at the time of installation of the air-conditioning apparatus.

The areas on the indoor pipe 9*a* and 9*b* in the vicinity of the joint portions 15*a* and 15*b*, which include the locations in which the temperature sensors 94*a* and 94*b* are arranged, the areas on the extension pipes 10*a* and 10*b* in the vicinity of the joint portions 15*a* and 15*b*, and the joint portions 15*a* and 15*b* are covered by a heat insulating material 82*a* different from the heat insulating material 82*b* to prevent condensation from being formed. That is, the temperature sensors 94*a* and 94*b* are covered by the heat insulating material 82*a* identical to the heat insulating material that covers the seam in the refrigerant pipe.

The heat insulating material 82*a* is attached by the installation operator during installation of the air-conditioning apparatus 100, after the extension pipes 10*a* and 10*b* are connected to the indoor pipes 9*a* and 9*b*, respectively. The heat insulating material 82*a* is often packaged together with the indoor unit 1 that is in a shipping state. The heat insulating material 82*a* has a shape of, for example, a cylinder tube split by a plane including the tube axis. The heat insulating material 82*a* is wrapped to cover an end portion of the heat insulating material 82*b* from the outside, and attached by using a band. The heat insulating material 82*a* is in close contact with those refrigerant pipes, and thus only a minute gap is present between the outer surface of each refrigerant pipe and the inner surface of the heat insulating material 82*a*.

The temperature sensors 94*a* and 94*b* only needs to be covered by a heat insulating material together with the seam in the refrigerant pipe. Consequently, the temperature sensors 94*a* and 94*b* may not necessarily be covered by a heat insulating material identical to the heat insulating material that covers the seam in the refrigerant pipe.

In the indoor unit 1, refrigerant is likely to leak at the location of a seam such as the joint portions 15*a* and 15*b* in which refrigerant pipes are joined together. In general, refrigerant that leaks to atmospheric pressure from the refrigerant circuit 40 undergoes adiabatic expansion and turns into a gas, which is dispersed into the atmosphere. When refrigerant undergoes adiabatic expansion and turns into a gas, the refrigerant removes heat from the surrounding air or other media.

In this regard, the joint portions 15*a* and 15*b* in which refrigerant is likely to leak is covered by the heat insulating material 82*a*. Consequently, when refrigerant undergoes adiabatic expansion and turns into a gas, the refrigerant is not able to remove heat from the air outside the heat insulating material 82*a*. The heat insulating material 82*a* has a small heat capacity, and hence the refrigerant is not able to remove almost any heat from the heat insulating material 82*a* as well. Thus, the leaking refrigerant removes heat mainly from the refrigerant pipe. At this time, the refrigerant pipe itself is heat-insulated with the heat insulating material from the air outside. Consequently, when the refrigerant pipe loses heat to the refrigerant, the temperature of the refrigerant pipe decreases corresponding to the amount of heat lost to the refrigerant, and the refrigerant pipe is maintained at the decreased temperature. As a result, the temperature of the refrigerant pipe in the vicinity of the leakage site drops to a cryogenic temperature approximately equal to the boiling point of the refrigerant (for example, approximately −29 degrees C. for HFO-1234yf), with the temperature of the refrigerant pipe dropping successively also at sites remote from the leakage site.

The refrigerant that has undergone adiabatic expansion and turned into a gas can hardly disperse into the air outside the heat insulating material 82*a*, and accumulates in the minute gap between the refrigerant pipe and the heat insulating material 82*a*. Then, when the temperature of the refrigerant pipe drops to the boiling point of the refrigerant, the gas refrigerant accumulating in the minute gap condenses again on the outer surface of the refrigerant pipe. The leaked refrigerant that has turned into a liquid through the re-condensation travels along the outer surface of the refrigerant pipe and the inner surface of the heat insulating material to disperse in the minute gap between the refrigerant pipe and the heat insulating material not only in the direction of gravity but also upward, that is, in the direction opposite to the direction of gravity.

Specifically, the gap between the outer surface of each of the indoor pipes 9*a* and 9*b* and the inner surface of the heat insulating material 82*a* is minute. Thus, the refrigerant at a cryogenic temperature that has turned into a liquid through the re-condensation in the vicinity of each of the joint portions 15*a* and 15*b* travels not only downward but also upward and sideways due to capillary action. Consequently, even when the temperature sensors 94*a* and 94*b* are provided to the indoor pipes 9*a* and 9*b* above the joint portions 15*a* and 15*b*, respectively, the temperature sensors 94*a* and 94*b* come into direct contact with the refrigerant at a cryogenic temperature.

At this time, each of the temperature sensors 94*a* and 94*b* measures the temperature of the liquid refrigerant at a cryogenic temperature that has infiltrated upward through the minute gap into direct contact with each of the temperature sensors 94*a* and 94*b*. Alternatively, the temperature sensors 94*a* and 94*b* measure the temperatures of the indoor pipes 9*a* and 9*b*, respectively, among the refrigerant pipes whose temperature has dropped to a cryogenic temperature.

Each of the heat insulating materials 82*a* and 82*b* is preferably formed of, for example, closed-cell foamed resin such as foamed polyethylene. This configuration helps to keep the leaked refrigerant existing in the minute gap between the refrigerant pipe and the heat insulating material from passing through the heat insulating material and leaking out to the air outside the heat insulating material. This configuration also ensures that the resulting heat insulating material has a small heat capacity.

Figure 6:
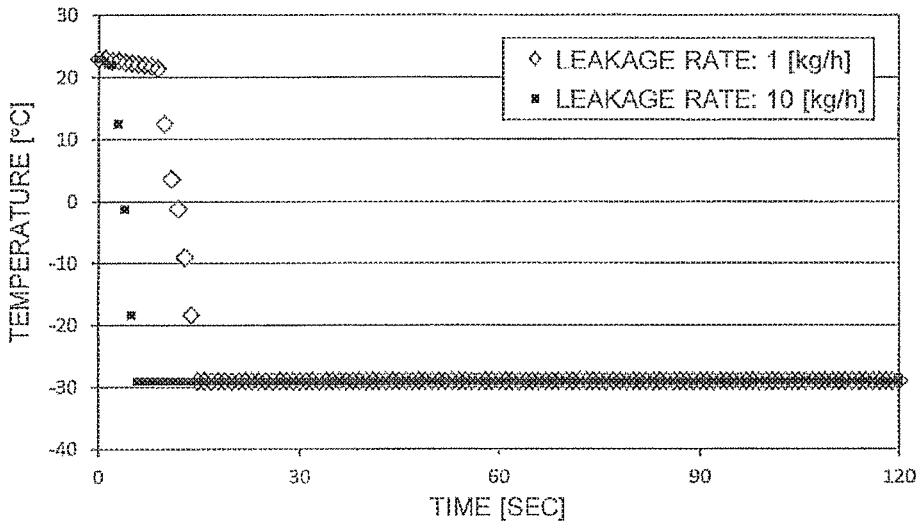
FIG. 6 is a graph for showing an example of how the temperature measured by a temperature sensor changes with time when refrigerant is caused to leak from a joint portion in the indoor unit of the air-conditioning apparatus according to Embodiment 1 of the present invention.

FIG. 6 is a graph for showing an example of how the temperature measured by the temperature sensor 94*b* changes with time when refrigerant is caused to leak from the joint portion 15*b* in the indoor unit 1 of the air-conditioning apparatus 100 according to Embodiment 1 of the present invention. The horizontal axis of the graph represents time elapsed [sec] since the start of refrigerant leakage, and the vertical axis represents temperature [degrees C.]. In FIG. 6, both changes in temperature with time at a leakage rate of 1 kg/h, and changes in temperature with time at a leakage rate of 10 kg/h are shown. HFO-1234yf is used as the refrigerant.

As shown in FIG. 6, as the leaked refrigerant undergoes adiabatic expansion and turns into a gas, the temperature measured by the temperature sensor 94*b* begins to drop immediately after the start of leakage. When the refrigerant begins to liquefy due to re-condensation during lapse of several to several tens of seconds after the start of leakage, the temperature measured by the temperature sensor 94*b* sharply drops to the boiling point of HFO-1234yf, which is approximately −29 degrees C. Subsequently, the temperature measured by the temperature sensor 94*b* is maintained at approximately −29 degrees C.

The refrigerant leakage site is covered by a heat insulating material as described above, and hence a temperature drop due to refrigerant leakage can be detected with no delay. Through covering of the refrigerant leakage site with a heat insulating material, it is possible to detect the temperature drop due to refrigerant leakage with good responsiveness, even when the refrigerant leaks at a relatively low rate of 1 kg/h.

It is desired that the refrigerant leakage detection processing be repeatedly executed at predetermined time intervals only when, for example, power is supplied to the air-conditioning apparatus 100, that is, when a breaker configured to supply power to the air-conditioning apparatus 100 is activated and the indoor fan 7*f* is in a stopped condition. While the indoor fan 7*f* is running, indoor air is stirred, and thus even when refrigerant leaks, the refrigerant is dispersed to prevent localized areas of elevated refrigerant concentration. Even when the indoor fan 7*f* is in a stopped condition, during the cooling operation and the defrosting operation in which the temperature of the indoor pipes 9*a* and 9*b* drops, the indoor pipes 9*a* and 9*b* are at a low temperature, which can be falsely detected as refrigerant leakage by the temperature sensors 94*a* and 94*b*, respectively. Consequently, whether or not to execute the refrigerant leakage detection processing is determined on the basis of refrigerant leakage detection permission-denial processing.

When a battery or uninterruptible power supply capable of supplying power to the indoor unit 1 is present, the refrigerant leakage detection processing may be executed also when the breaker is deactivated.

The refrigerant leakage detection processing may be executed irrespective of the operational state of the compressor 3. That is, the refrigerant leakage detection processing using the temperature sensors 94*a* and 94*b* may be executed both when the compressor 3 is in a stopped condition and when the compressor 3 is running. Alternatively, the refrigerant leakage detection processing may be executed only when the compressor 3 is in a stopped condition or only when the compressor 3 is running.

Figure 7:
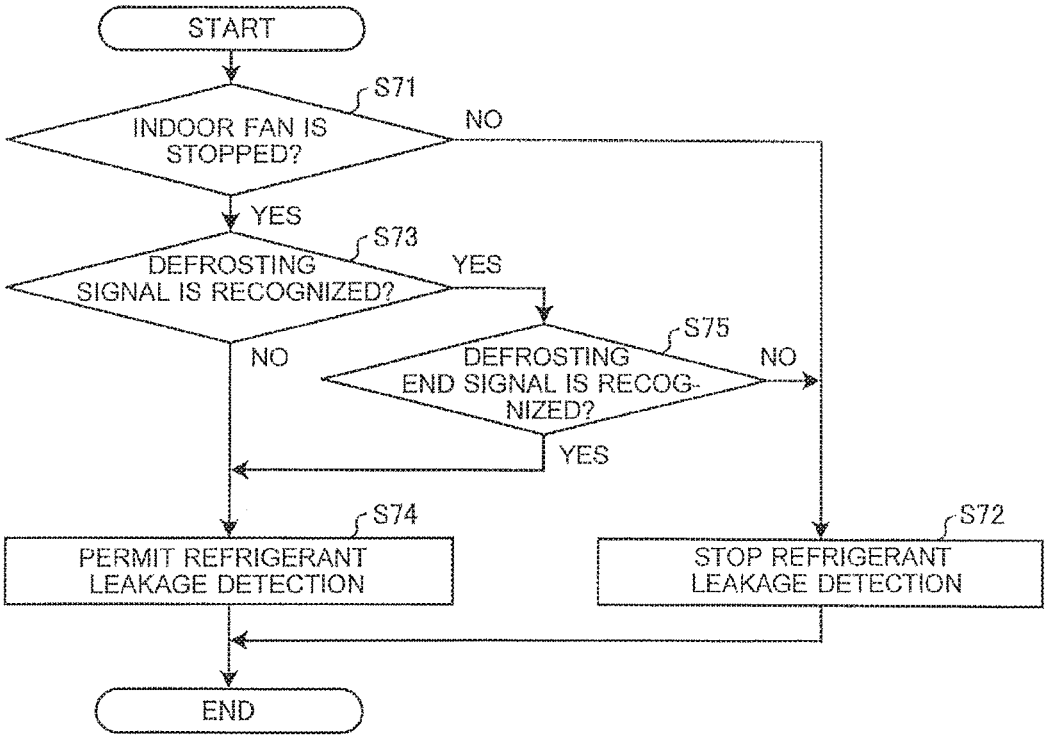
FIG. 7 is a flowchart for illustrating an example of refrigerant leakage detection permission-denial processing executed by a controller of the air-conditioning apparatus according to Embodiment 1 of the present invention.

FIG. 7 is a flowchart for illustrating an example of refrigerant leakage detection permission-denial processing executed by the controller 30 of the air-conditioning apparatus 100 according to Embodiment 1 of the present invention. The refrigerant leakage detection permission-denial processing is repeatedly executed at predetermined time intervals.

In Step S71 in FIG. 7, the controller 30 determines whether or not the indoor fan 7*f* is in a stopped condition. When the indoor fan 7*f* is in a stopped condition, the processing proceeds to Step S73. When the indoor fan 7*f* is running, the processing proceeds to Step S72, in which the determination of the presence of refrigerant leakage is stopped, and the refrigerant leakage detection processing is not allowed to be executed.

In Step S73, the controller 30 determines whether or not a defrosting signal S1 has been recognized. The defrosting signal S1 is issued when the following condition, for example, is met during the heating operation as a condition for starting the defrosting operation, the outdoor temperature is equal to or lower than a preset temperature, a predetermined time has elapsed since the activation of the compressor 3, and the temperature measured by the heat exchanger liquid pipe temperature sensor 92 has continued to be equal to or lower than a preset temperature for a predetermined period of time. The controller 30 starts the defrosting operation when the controller 30 recognizes the defrosting signal S1.

When the defrosting signal S1 has not been recognized, the processing proceeds to Step S74, in which the determination of the presence of refrigerant leakage is permitted and the refrigerant leakage detection processing is executed. When the defrosting signal S1 has been recognized, the processing proceeds to Step S75.

In Step S75, the controller 30 determines whether or not a defrosting end signal S2 has been recognized. The defrosting end signal S2 is issued when the following condition, for example, is met during the defrosting operation, which is performed in the middle of the heating operation and is started when the defrosting signal S1 is recognized, as a condition for ending the defrosting operation, a predetermined time has elapsed since the start of the defrosting operation, or the temperature measured by the heat exchanger liquid pipe temperature sensor 92 has continued to be equal to or higher than a preset temperature for a predetermined period of time. When the controller 30 recognizes the defrosting end signal S2, the controller 30 ends the defrosting operation and returns to the heating operation.

When the defrosting end signal S2 has been recognized, the processing proceeds to Step S74, in which the determination of the presence of refrigerant leakage is permitted and the refrigerant leakage detection processing is executed. When the defrosting end signal S2 has not been recognized, it is determined that the defrosting operation is still being performed even through the indoor fan 7*f* is in a stopped condition, and the processing proceeds to Step S72, in which the determination of the presence of refrigerant leakage is stopped, and the refrigerant leakage detection processing is not allowed to be executed.

Figure 8:
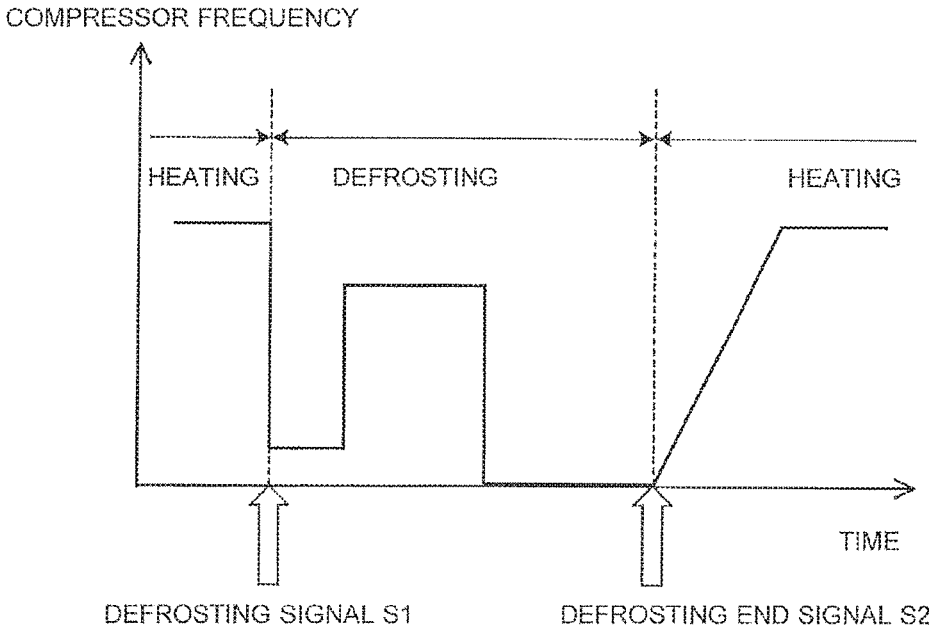
FIG. 8 is a time chart for illustrating an example of timing when refrigerant leakage detection is permitted or denied by the controller of the air-conditioning apparatus according to Embodiment 1 of the present invention.

FIG. 8 is a time chart for illustrating an example of timing when refrigerant leakage detection is permitted or denied by the controller 30 of the air-conditioning apparatus 100 according to Embodiment 1 of the present invention.

As illustrated in FIG. 8, the controller 30 determines the duration of the defrosting operation, for which the controller 30 stops the determination of the presence of refrigerant leakage, as the interval of time between recognition of the defrosting signal S1 and recognition of the defrosting end signal S2.

When the controller 30 recognizes the defrosting signal S1, the controller 30 lowers the frequency of the compressor 3 so that the refrigerant flow switching device 4 is switched from the heating operation side to the defrosting operation side similar to the cooling operation side. Subsequently, the controller 30 raises the frequency of the compressor 3 for a predetermined period of time. Then, the outdoor heat exchanger 5 is defrosted. Subsequently, the controller 30 stops the compressor 3, and keeps that state for a predetermined period of time. This configuration allows the refrigerant to stabilize. The indoor fan 7*f* is in a stopped condition during this processing. Then, the controller 30 recognizes the defrosting end signal S2, and switches the refrigerant flow switching device 4 to the heating operation side so that frequency of the compressor 3 is gradually raised to resume the heating operation.

Figure 9:
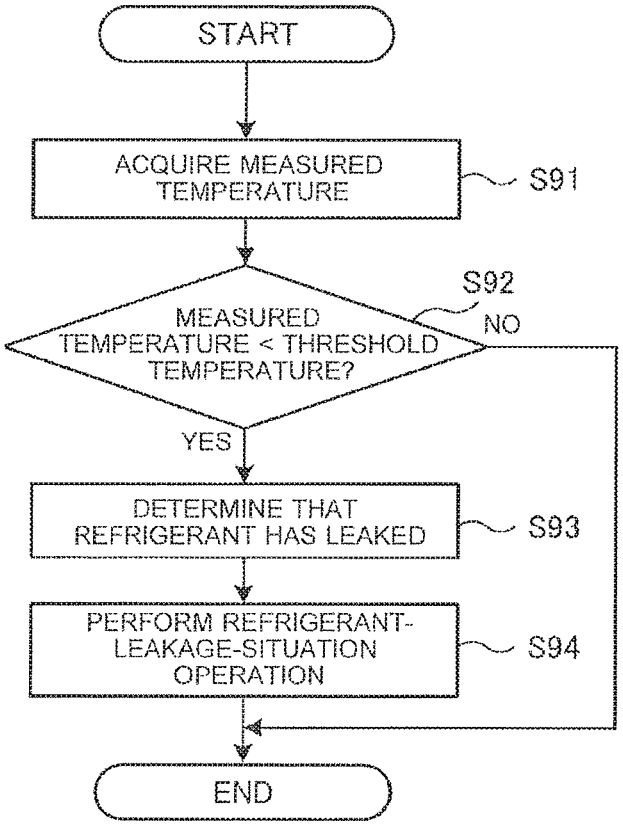
FIG. 9 is a flowchart for illustrating an example of refrigerant leakage detection processing executed by the controller of the air-conditioning apparatus according to Embodiment 1 of the present invention.

FIG. 9 is a flowchart for illustrating an example of refrigerant leakage detection processing executed by the controller 30 of the air-conditioning apparatus 100 according to Embodiment 1 of the present invention. The refrigerant leakage detection processing is repeatedly executed at predetermined time intervals while the refrigerant leakage detection is permitted by the refrigerant leakage detection permission-denial processing.

In Embodiment 1, refrigerant leakage detection processing procedures using the respective temperature sensors 94*a* and 94*b* are executed in parallel. The following description is only directed to the refrigerant leakage detection processing executed by using the temperature sensor 94*b*.

In Step S91 of FIG. 9, the controller 30 acquires information on the temperature measured by the temperature sensor 94*b*.

In Step S92, the controller 30 determines whether or not the temperature measured by the temperature sensor 94*b* is lower than a preset threshold temperature, for example, −10 degrees C. When the measured temperature is lower than the threshold temperature, the processing proceeds to Step S93. When the measured temperature is equal to or higher than the threshold temperature, the refrigerant leakage detection processing is ended.

In Step S93, the controller 30 determines that refrigerant has leaked. In this case, the processing proceeds to Step S94.

In Step S94, the controller 30 performs a refrigerant-leakage-situation operation, which is an operation to be performed when refrigerant has leaked.

That is, when it is determined that refrigerant has leaked, the compressor 3 is stopped and the indoor fan 7*f* is run for a predetermined period of time. As a result, the indoor air is stirred and the leaked refrigerant is caused to disperse. This operation prevents localized areas of elevated refrigerant concentration. Consequently, formation of flammable concentration regions is prevented even when a flammable refrigerant is used.

That is, in the refrigerant-leakage-situation operation, the controller 30 may set the system status of the air-conditioning apparatus 100 to "Abnormal", and may not permit components other than the indoor fan 7*f* to operate.

When the controller 30 determines that refrigerant has leaked, the controller 30 may inform the user of the abnormal condition with use of a display or audio output unit, which is an informing unit provided in the operating unit 26. For example, the controller 30 causes an instruction such as "Gas has leaked. Open the window" to be displayed on the display provided in the operating unit 26. As a result, the user is able to immediately recognize that refrigerant has leaked, and that a measure such as ventilation should be taken. This operation ensures that localized areas of elevated refrigerant concentration can be prevented with greater reliability.

The above-mentioned configuration enables refrigerant leakage to be detected reliably and with good responsiveness over an extended period of time. The above-mentioned configuration also enables the number of temperature sensors to be reduced, thus allowing for reduced manufacturing cost of the air-conditioning apparatus 100.

According to Embodiment 1, the air-conditioning apparatus 100 includes the refrigerant circuit 40 in which the compressor 3, the indoor heat exchanger 7, the pressure reducing device 6, the outdoor heat exchanger 5, and the refrigerant flow switching device 4 configured to switch operation to the heating operation or the defrosting operation are connected by the refrigerant pipe to circulate refrigerant. The air-conditioning apparatus 100 includes the indoor fan 7*f* configured to supply air to the indoor heat exchanger 7. The air-conditioning apparatus 100 includes the temperature sensors 94*a* and 94*b*, which are each located in the vicinity of the outlet or inlet of the indoor heat exchanger 7 in the refrigerant circuit 40, and which are disposed in areas adjacent to seams in the refrigerant pipe in which the joint portions 15*a* and 15*b* is located, respectively. The air-conditioning apparatus 100 includes the controller 30 configured to determine the presence of refrigerant leakage on the basis of a decrease in the temperature measured by one of the temperature sensors 94*a* and 94*b*. The controller 30 is configured to determine the presence of refrigerant leakage while the indoor fan 7*f* is stopped. The controller 30 is configured to stop the determination of the presence of refrigerant leakage while the defrosting operation is performed.

According to this configuration, when the indoor fan 7*f* is in a stopped condition, in which the refrigerant concentration locally increases at a time of refrigerant leakage, the controller 30 determines the presence of refrigerant leakage on the basis of a decrease in the temperature measured by one of the temperature sensors 94*a* and 94*b*. That is, the controller 30 can perform the determination of the presence of refrigerant leakage when the refrigerant that has leaked from a seam in the refrigerant pipe is not dispersed by the air-sending operation of the indoor fan 7*f* and thus the concentration of the leaked refrigerant increases to cause a decrease in the temperature of the surroundings of the refrigerant. Further, during the defrosting operation in which the refrigerant pipe provided with one of the temperature sensors 94*a* and 94*b* is at a decreased temperature, the controller 30 stops the determination of the presence of refrigerant leakage. This configuration prevents false detection of refrigerant leakage from being made when the temperature of the refrigerant pipe is low.

According to Embodiment 1, the controller 30 is configured to determine the duration of the defrosting operation, for which the controller 30 stops the determination of the presence of refrigerant leakage, as the interval of time between recognition of the defrosting signal S1 and recognition of the defrosting end signal S2.

According to this configuration, the duration of the defrosting operation, for which the determination of the presence of refrigerant leakage is stopped, can be determined as the interval of time between recognition of the defrosting signal S1 and recognition of the defrosting end signal S2. This configuration simplifies the control.

According to Embodiment 1, the temperature sensors 94*a* and 94*b* are covered by the heat insulating material 82*a*, together with the seam in the refrigerant pipe.

This configuration ensures that the refrigerant that has leaked from the seam in the refrigerant pipe is dispersed in the space between the outer surface of the refrigerant pipe and the inner surface of the heat insulating material 82*a*. Thus, the leaked low-temperature refrigerant directly reaches each of the temperature sensors 94*a* and 94*b* at an early point. As a result, each of the temperature sensors 94*a* and 94*b* measures not the temperature of the refrigerant pipe but the temperature of the leaked low-temperature refrigerant. This configuration enables early detection of refrigerant leakage.

According to Embodiment 1, the temperature sensors 94*a* and 94*b* are covered by the heat insulating material 82*a* identical to the heat insulating material that covers the seam in the refrigerant pipe.

According to this configuration, the refrigerant that has leaked from the seam in the refrigerant pipe is dispersed in the space between the outer surface of the refrigerant pipe and the inner surface of the heat insulating material 82*a* leading to the temperature sensors 94*a* and 94*b*, without any leakages during this dispersion process. This configuration ensures that the leaked low-temperature refrigerant readily reaches the temperature sensors 94*a* and 94*b* directly at an early point. As a result, each of the temperature sensors 94*a* and 94*b* measures not the temperature of the refrigerant pipe but the temperature of the leaked low-temperature refrigerant. This configuration enables earlier detection of refrigerant leakage.

According to Embodiment 1, the refrigerant pipe includes the indoor pipe 9*a* and 9*b* arranged in the indoor unit 1, and the extension pipes 10*a* and 10*b* extended downward from the indoor pipe 9*a* and 9*b* via the seams, respectively. The temperature sensors 94*a* and 94*b* are provided to the indoor pipes 9*a* and 9*b* located above the seams in the refrigerant pipes, respectively.

This configuration allows the temperature sensors 94*a* and 94*b* to be positioned in advance in the indoor unit 1 that is in its pre-installation state. This configuration eliminates the need for positioning the temperature sensors 94*a* and 94*b* at the time of installation of the indoor unit 1 when the refrigerant pipe is connected, which in turn improves working efficiency and eliminates variations in the positioning of the temperature sensors 94*a* and 94*b* or errors in installation. Although the temperature sensors 94*a* and 94*b* are provided to the indoor pipes 9*a* and 9*b* located above the seams in the refrigerant pipes, respectively, the temperature sensors 94*a* and 94*b* are covered by the heat insulating material 82*a*, together with the seam in the refrigerant pipe. In this case, the refrigerant that has leaked from the seam in the refrigerant pipe is dispersed in the space between the outer surface of the refrigerant pipe and the inner surface of the heat insulating material 82*a* also in a direction opposite to the direction of gravity. This configuration ensures that the leaked low-temperature refrigerant reaches the temperature sensors 94*a* and 94*b* each located above the seam at an early point. As a result, each of the temperature sensors 94*a* and 94*b* measures not the temperature of the refrigerant pipe but the temperature of the leaked low-temperature refrigerant. This configuration enables early detection of refrigerant leakage.

The refrigerant leakage detection method according to Embodiment 1 includes measuring, in the refrigerant circuit 40 in which refrigerant is circulated to perform the heating operation, in which air is supplied to the indoor heat exchanger 7 with use of the indoor fan 7*f*, or the defrosting operation, the temperature of an area in the vicinity of a seam in the refrigerant pipe in which one of the joint portions 15*a* and 15*b* is located. With the refrigerant leakage detection method, while the indoor fan 7*f* is stopped, the presence of refrigerant leakage is determined on the basis of a decrease in measured temperature. With the refrigerant leakage detection method, while the defrosting operation is performed, the determination of the presence of refrigerant leakage based on a decrease in measured temperature is stopped.

According to this configuration, when the indoor fan 7*f* is in a stopped condition, in which the refrigerant concentration locally increases at a time of refrigerant leakage, the controller 30 determines the presence of refrigerant leakage on the basis of a decrease in the temperature measured by one of the temperature sensors 94*a* and 94*b*. That is, the controller 30 can perform the determination of the presence of refrigerant leakage when the refrigerant that has leaked from a seam in the refrigerant pipe is not dispersed by the air-sending operation of the indoor fan 7*f* and thus the concentration of the leaked refrigerant increases to cause a decrease in the temperature of the surroundings of the refrigerant. Further, during defrosting operation in which the refrigerant pipes provided with the temperature sensors 94*a* and 94*b* are at a decreased temperature, the controller 30 stops the determination of the presence of refrigerant leakage. This configuration prevents false detection of refrigerant leakage from being made when the temperature of the refrigerant pipe is low.

Embodiment 2

In Embodiment 2 of the present invention, outdoor refrigerant temperature is measured by the outdoor pipe temperature sensor 90 arranged in the outdoor heat exchanger 5 of the outdoor unit 2, and when the outdoor refrigerant temperature is higher than the temperature measured by one of the temperature sensors 94*a* and 94*b* used to determine the presence of refrigerant leakage, the refrigerant leakage detection processing is executed even during the defrosting operation. In Embodiment 2, features similar to those in Embodiment 1 are not described, and the description focuses only on its characteristic features.

Figure 10:
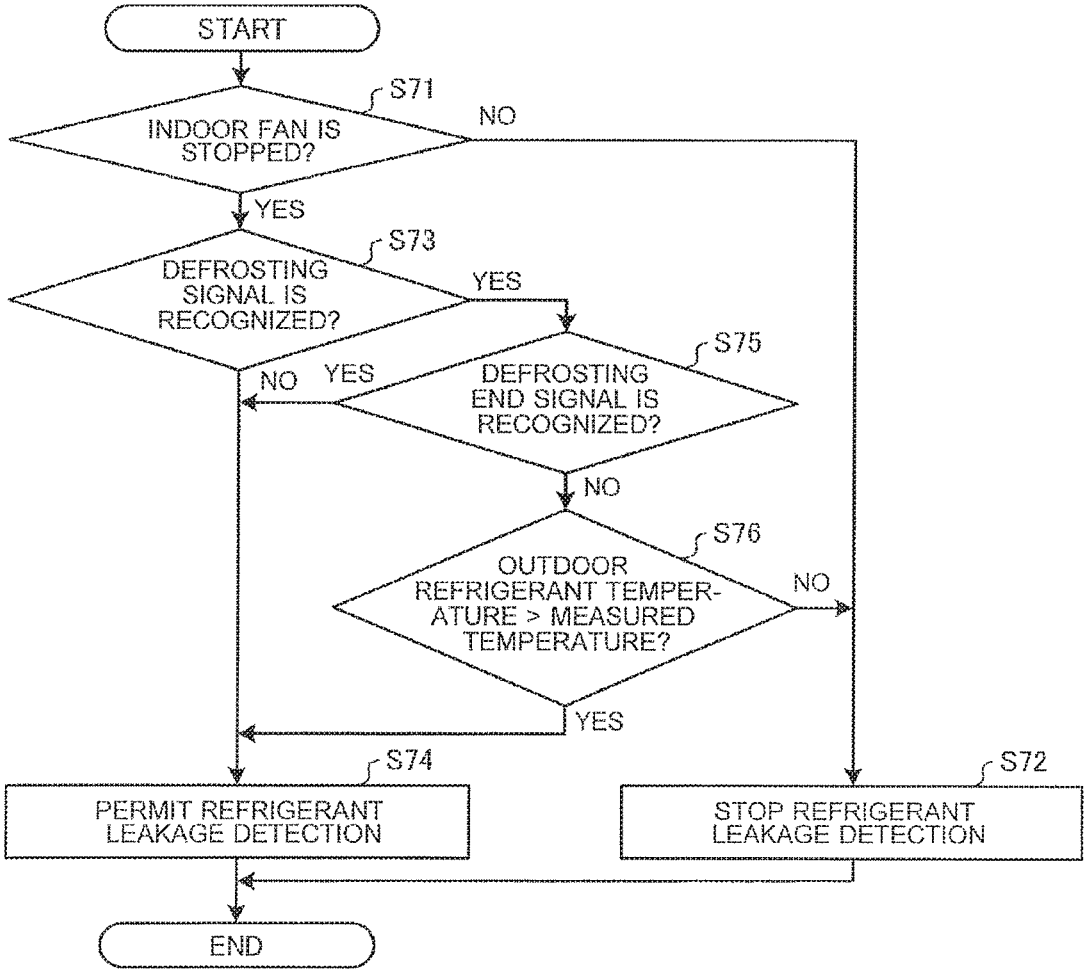
FIG. 10 is a flowchart for illustrating an example of refrigerant leakage detection permission-denial processing executed by a controller of an air-conditioning apparatus according to Embodiment 2 of the present invention.

FIG. 10 is a flowchart for illustrating an example of refrigerant leakage detection permission-denial processing executed by a controller of an air-conditioning apparatus according to Embodiment 2 of the present invention. The following description focuses only on features different from those of the flowchart illustrated in FIG. 7.

In Step S75, the controller 30 determines whether or not a defrosting end signal S2 has been recognized. The defrosting end signal S2 is issued when the following condition, for example, is met during the defrosting operation, which is performed in the middle of the heating operation, as a condition for ending the defrosting operation, a predetermined time has elapsed since the start of the defrosting operation, or the temperature measured by the heat exchanger liquid pipe temperature sensor 92 has continued to be equal to or higher than a preset temperature for a predetermined period of time. When the controller 30 recognizes the defrosting end signal S2, the controller 30 ends the defrosting operation and returns to the heating operation.

When the defrosting end signal S2 has been recognized, the processing proceeds to Step S74, in which the determination of the presence of refrigerant leakage is permitted and the refrigerant leakage detection processing is executed. When the defrosting end signal S2 has not been recognized, it is determined that defrosting operation is still being performed, and the processing proceeds to Step S76.

In Step S76, the controller 30 determines whether or not the outdoor refrigerant temperature measured by the outdoor pipe temperature sensor 90 arranged in the outdoor heat exchanger 5 of the outdoor unit 2 is higher than the temperature measured by one of the temperature sensors 94*a* and 94*b*. When the outdoor refrigerant temperature is higher than the temperature measured by one of the temperature sensors 94*a* and 94*b*, the processing proceeds to Step S74, in which the determination of the presence of refrigerant leakage is permitted and the refrigerant leakage detection processing is executed. When the outdoor refrigerant temperature is equal to or lower than the temperature measured by one of the temperature sensors 94*a* and 94*b*, the processing proceeds to Step S72, in which the determination of the presence of refrigerant leakage is stopped, and the refrigerant leakage detection processing is not allowed to be executed.

According to Embodiment 2, the air-conditioning apparatus 100 includes the refrigerant circuit 40 in which the compressor 3, the indoor heat exchanger 7, the pressure reducing device 6, the outdoor heat exchanger 5, and the refrigerant flow switching device 4 configured to switch operation to the heating operation or the defrosting operation are connected by the refrigerant pipe to circulate refrigerant. The air-conditioning apparatus 100 includes the outdoor pipe temperature sensor 90 to measure outdoor refrigerant temperature. The air-conditioning apparatus 100 includes the temperature sensor 94*a* and 94*b* each located in the vicinity of the outlet or inlet of the indoor heat exchanger 7 in the refrigerant circuit 40, and provided in areas adjacent to seams in the refrigerant pipe in which the joint portions 15*a* are 15*b* are located, respectively. The air-conditioning apparatus 100 includes the controller 30 configured to determine the presence of refrigerant leakage on the basis of a decrease in the temperature measured by one of the temperature sensors 94*a* and 94*b*. When the outdoor refrigerant temperature measured by the outdoor pipe temperature sensor 90 is higher than the temperature measured by one of the temperature sensors 94*a* and 94*b*, the controller 30 determines the presence of refrigerant leakage while the defrosting operation is performed. When the outdoor refrigerant temperature measured by the outdoor pipe temperature sensor 90 is equal to or lower than the temperature measured by one of the temperature sensors 94*a* and 94*b*, the controller 30 stops the determination of the presence of refrigerant leakage while the defrosting operation is performed.

According to this configuration, even during the defrosting operation in which the refrigerant pipe is at a decreased temperature, the determination of the presence of refrigerant leakage is performed when the outdoor refrigerant temperature is higher than the temperature measured by one of the temperature sensors 94*a* and 94*b*, and the temperature of the refrigerant pipe is not so low as to cause false detection of refrigerant leakage. As a result, the length of time during which the determination of the presence of refrigerant leakage can be performed is extended to include a part of the duration of the defrosting operation, thus enabling early detection of refrigerant leakage.

The refrigerant leakage detection method according to Embodiment 2 includes measuring, in the refrigerant circuit in which refrigerant is circulated to perform the heating operation or the defrosting operation, the outdoor refrigerant temperature and the temperature of an area in the vicinity of a seam in the refrigerant pipe in which one of the joint portions 15*a* and 15*b* is located. The refrigerant leak detection method also includes determining, when the outdoor refrigerant temperature is higher than the temperature of the area in the vicinity of the seam in the refrigerant pipe in which one of the joint portions 15*a* and 15*b* is located, the presence of refrigerant leakage while the defrosting operation is performed, on the basis of a decrease in the temperature of the area in the vicinity of the seam in the refrigerant pipe in which one of the joint portions 15*a* and 15*b* is located. The refrigerant leak detection method further includes stopping, when the outdoor refrigerant temperature is equal to or lower than the temperature of the area in the vicinity of the seam in the refrigerant pipe in which one of the joint portions 15*a* and 15*b* is located, while the defrost operation is performed, the determination of the presence of refrigerant leakage on the basis of a decrease in the temperature of the area in the vicinity of the seam in the refrigerant pipe in which one of the joint portions 15*a* and 15*b* is located.

According to this configuration, even during the defrosting operation in which the refrigerant pipe is at a decreased temperature, the determination of the presence of refrigerant leakage is performed when the outdoor refrigerant temperature is higher than the temperature measured by one of the temperature sensors 94*a* and 94*b*, and the temperature of the refrigerant pipe is not so low as to cause false detection of refrigerant leakage. As a result, the length of time during which the determination of the presence of refrigerant leakage can be performed is extended to include a part of the duration of the defrosting operation, thus enabling early detection of refrigerant leakage.

Other Embodiments

The present invention is not limited to the above-mentioned embodiments, and various modifications can be made.

For example, although the above-mentioned embodiments are directed to a case in which the indoor unit 1 is of a floor type, the present invention is also applicable to indoor units of other types such as a ceiling cassette type, a ceiling concealed type, a ceiling suspended type, and a wall type.

Although the above-mentioned embodiments are directed to a case in which the temperature sensor used for refrigerant leakage detection is provided in the indoor unit 1, the temperature sensor used for refrigerant leakage detection may be provided in the outdoor unit 2. In this case, the temperature sensor used for refrigerant leakage detection is provided in an area of a component, for example, the outdoor heat exchanger 5, that is in the vicinity of a seam in the refrigerant pipe, for example, a brazed portion, and is covered by a heat insulating material together with the brazed portion. Alternatively, the temperature sensor used for refrigerant leakage detection is provided in an area in the outdoor unit 2 that is in the vicinity of a seam in the refrigerant pipe, for example, a joint between refrigerant pipes, and is covered by a heat insulating material together with the joint. The controller 30 determines the presence of refrigerant leakage on the basis of the temperature measured by the temperature sensor used for refrigerant leakage detection. This configuration allows refrigerant leakage in the outdoor unit 2 to be detected reliably and with good responsiveness over an extended period of time.

The invention claimed is:

1. An air-conditioning apparatus, comprising:

a refrigerant circuit in which a compressor, an indoor heat exchanger, an expansion device, an outdoor heat exchanger, and a switching device configured to switch operation to a heating operation or a defrosting operation are connected by a refrigerant pipe to circulate refrigerant;

an outdoor pipe temperature sensor configured to measure an outdoor refrigerant temperature;

a temperature sensor located in a vicinity of at least one of an outlet and an inlet of the indoor heat exchanger in the refrigerant circuit, the temperature sensor being provided in an area adjacent to a seam in the refrigerant pipe; and a controller configured to determine presence of refrigerant leakage on a basis of a decrease in temperature measured by the temperature sensor, when the outdoor refrigerant temperature measured by the outdoor pipe temperature sensor is higher than the temperature measured by the temperature sensor, the controller being configured to determine presence of refrigerant leakage during a period in which the defrosting operation is performed, and when the outdoor refrigerant temperature measured by the outdoor pipe temperature sensor is equal to or lower than the temperature measured by the temperature sensor, the controller being configured to stop determination of presence of refrigerant leakage during the period in which the defrosting operation is performed.

2. The air-conditioning apparatus of claim 1, wherein the temperature sensor and the seam in the refrigerant pipe are covered by at least one heat insulating material.

3. The air-conditioning apparatus of claim 2, wherein the temperature sensor is covered by a heat insulating material identical to the heat insulating material covering the seam in the refrigerant pipe.

4. The air-conditioning apparatus of claim 2, wherein the refrigerant pipe includes an indoor pipe provided in an indoor unit, and an extension pipe extended downward from the indoor pipe via the seam, and wherein the temperature sensor is provided to the indoor pipe located above the seam in the refrigerant pipe.

5. A refrigerant leakage detection method, comprising:

measuring, in a refrigerant circuit in which refrigerant is circulated to perform a heating operation or a defrosting operation, an outdoor refrigerant temperature, and a temperature of an area in a vicinity of a seam in a refrigerant pipe;

determining, when the outdoor refrigerant temperature is higher than the temperature of the area in the vicinity of the seam in the refrigerant pipe, presence of refrigerant leakage during a period in which the defrosting operation is performed, on a basis of a decrease in temperature of the area in the vicinity of the seam in the refrigerant pipe; and stopping, when the outdoor refrigerant temperature is equal to or lower than the temperature of the area in the vicinity of the seam in the refrigerant pipe, determination of presence of refrigerant leakage during the period in which the defrosting operation is performed on the basis of the decrease in temperature of the area in the vicinity of the seam in the refrigerant pipe.

6. The air-conditioning apparatus of claim 3, wherein the refrigerant pipe includes an indoor pipe provided in an indoor unit, and an extension pipe extended downward from the indoor pipe via the seam, and wherein the temperature sensor is provided to the indoor pipe located above the seam in the refrigerant pipe.

* * * * *